United States Patent [19]

Eberle et al.

[11] Patent Number: 4,834,147

[45] Date of Patent: May 30, 1989

[54] WEFT THREAD CUTTING MECHANISM FOR SHUTTLELESS LOOMS

[75] Inventors: Alois Eberle; Erich Peter; Rainer Steinberger, all of Lindau, Fed. Rep. of Germany

[73] Assignee: Lindauer Dornier Gesellschaft mbH, Lindau/Bodensee, Fed. Rep. of Germany

[21] Appl. No.: 152,422

[22] Filed: Feb. 3, 1988

[30] Foreign Application Priority Data

Feb. 6, 1987 [DE] Fed. Rep. of Germany ..... 3703638

[51] Int. Cl.[4] ..... D03D 47/34

[52] U.S. Cl. ..... 139/450; 139/263; 139/302

[58] Field of Search ..... 139/450, 429, 302, 194, 139/263, 438, 439

[56] References Cited

U.S. PATENT DOCUMENTS

| | | | |
|---|---|---|---|
| 3,518,883 | 5/1970 | Kingdom | 139/263 X |
| 3,598,158 | 8/1971 | Hall | 139/263 |
| 3,960,186 | 6/1976 | Wheeler | 139/450 |
| 4,143,684 | 3/1979 | Lindenmueller et al. . | |
| 4,646,790 | 3/1987 | Lutz | 139/450 X |

FOREIGN PATENT DOCUMENTS

| | | |
|---|---|---|
| 1535493 | 6/1973 | Fed. Rep. of Germany . |
| 3042053 | 11/1982 | Fed. Rep. of Germany . |

*Primary Examiner*—Andrew M. Falik

*Attorney, Agent, or Firm*—W. G. Fasse; D. H. Kane, Jr.

[57] ABSTRACT

A scissors mechanism for cutting the weft thread in a shuttleless loom performs an excess stroke to bring the scissors mechanism, which is combined with a clamping mechanism, as close to the weft thread insertion gripper as possible in order to reduce weft thread waste. For this purpose, the fixed scissors blade is tiltable between a working position and a rest position in a plane extending substantially perpendicularly to the weft thread insertion direction. The movable scissors blade cooperates with a clamping arm for clamping the weft thread just prior to its cutting. For this purpose the movable scissors blade carries a clamping jaw next to its cutting edge and the clamping jaw cooperates with a clamping plate attached to a clamping arm coaxially mounted with the movable scissors blade. An excess stroke motion of the entire mechanism moves the clamp formed by the clamping jaw and the clamping plate into a position close to the gripper guide track after the weft thread has been clamped in the scissors clamp.

9 Claims, 8 Drawing Sheets

WEFT THREAD CUTTING MECHANISM FOR SHUTTLELESS LOOMS

FIELD OF THE INVENTION

The invention relates to a weft thread cutting mechanism for shuttleless looms in which the weft thread is inserted into a loom shed by weft thread inserting grippers travelling back and forth into the loom shed.

DESCRIPTION OF THE PRIOR ART

Conventional thread cutting devices include so-called scissors tiltable in a direction extending across the weft thread inserting direction for moving the scissors from a rest position into a working position and vice versa. The scissors have a fixed scissors blade and a movable scissors blade. The fixed scissors blade is rigidly secured to a tiltable arm operated by an eccentric cam drive. The movable scissors blade is journalled to the fixed scissors blade. The movement of the movable scissors blade is controlled by the motion of the tiltable arm. Usually these devices also include a holding device for grasping the weft thread end. The holding device is displaceable from a position near the scissors to a position near the weft thread inserting gripper.

In shuttleless looms the weft thread is withdrawn from large supply reels and the individual threads are led to the gripper head of a weft thread inserting gripper rod which carries the weft thread into the loom shed. For this operation the gripper head is equipped with a special clamping device that travels back and forth with the gripper head. Outside of the loom shed there are provided special cutting mechanisms located between the supply reel and the edge of the fabric for cutting the weft thread in such a manner that its free end can be pulled through the loom shed. The other free end of the thread still connected to the supply reel is held in place and made ready for a new weft thread insertion. As mentioned above, scissors type cutting mechanisms are known which ar arranged close to the fabric edge for the above purpose.

Different types of scissors and weft thread inserting devices are used in practice. For example, there are scissors in which one scissors blade is fixed to the machine frame and the other scissors blade is movable relative to the fixed scissors blade. German Patent Publication (DE-PS) No. 1,535,493 discloses a scissors for cutting the inserting weft thread. The scissors according to this reference not only perform a cutting motion, but also a further motion which is superimposed on the cutting motion. More specifically, the scissors are moved from the cutting position into another position relative to the fabric web or relative to the presented weft threads. The displacement or superimposed motion takes place in a plane extending perpendicularly to the weft thread insertion direction and perpendicularly to the plane of the fabric web. This displacement or superimposed motion is controlled by a control mechanism in dependence or in response to other structural components of the loom, for example, by the motion of the weft thread inserting mechanism or by the motion of the loom reed.

Another weft thread cutting mechanism is known from U.S. Pat. No. 4,143,684. In this mechanism a fixed scissors blade is mounted to an arm which is tiltable by an eccentric cam drive for moving the scissors up and down along a path extending across the weft thread insertion direction. The movable scissors blade is constructed as a two-armed lever which is controlled by a fixed connecting link type guide. In this arrangement the weft thread end still connected with the supply reel is held by a suction device after the cutting is completed. The suction device holds the thread until the forward moving gripper head of the clamping device seizes the cut end of the weft thread while the gripper head moves forward into the loom shed. In this type of arrangement the weft thread ends extending out of the gripper head clamping device are relatively long and must later be cut off as waste. Such waste is undesirable.

In order to reduce the disadvantageous weft thread waste, German Patent Publication (DE-PS) No. 3,042,053 discloses a weft thread scissors which is also moved on a path across the weft thread insertion direction by an eccentric cam drive, whereby the movable scissors blade is controlled by the tilting movement of the weft thread scissors. However, the suction device for holding the cut end of the weft thread is replaced by mechanical clamping mechanism. The mechanical clamping mechanism is displaceable back and forth between two position, one of which is close to the scissors and the other of which is close to the clamping device of the gripper head. This mechanical clamping mechanism seizes the weft thread end still connected with the supply reel after the cutting and brings that end into the vicinity of the gripper clamping device, whereby weft thread waste is reduced. However, this type of construction requires a separate holding mechanism and a special control mechanism for the holding of the weft thread and for the displacement of the holding mechanism located between the scissors and the gripper guide track.

OBJECTS OF THE INVENTION

In view of the foregoing it is the aim of the invention to achieve the following objects singly or in combination:

to construct, locate, and control the weft thread scissors for a shuttleless loom in such a manner that the weft thread waste is further reduced while avoiding the involved additional holding device between the scissors and the clamping mechanism of the weft thread gripper head, thereby also avoiding the control mechanism for the holding device;

to assure a positive, yet careful and gentle handling of the weft thread while presenting the weft thread to the gripper head in a stretched condition by holding the weft thread substantially at all times; and to assure a thread clamping just prior to the thread cutting while reducing the clamping force just prior to presenting the thread to the gripper head.

SUMMARY OF THE INVENTION

The weft thread cutting mechanism according to the invention is characterized in that the movable scissors blade is arranged on the side of the stationary scissors blade facing away from the loom shed. Further, the movable scissors blade has a clamping jaw next to its cutting edge. The clamping jaw bears against a spring biassed clamping plate during the cutting operation, wherein the movable scissors blade and the clamping plate a scissors clamp mounted for displacement in unison by an excess stroke motion in the direction toward the path of the weft thread gripper head while clamping the weft thread that is still connected with its supply reel. Thus, the invention makes sure that the cut weft thread end is directly clamped by one member of the scissors next to the cutting location, whereupon the clamping scissors member is caused to perform the excess stroke motion with its clamping member to bring the cut weft thread end close to the clamping device of the weft thread gripper head.

According to a further feature of the invention a clamping effect of the weft thread scissors is maintained during the thread transfer from the scissors clamp to the gripper head. This feature assures a safe, yet gentle and careful transfer of the weft thread end from the scissors clamp to the clamping device of the gripper head. However, during this presentation and transfer phase the holding force of the scissors clamp is reduced so that the gripper head travelling in the forward direction can easily pull out the weft thread end from the scissors clamp without unduly stressing the weft thread.

Advantages of the invention are seen in that the weft thread waste between the weft thread scissors in its excess stroke position and the clamping device of the gripper head is reduced to a minimum. Further, the weft thread remains securely held and stretched during the entire operation, yet, the weft thread end can be transferred or taken over by the gripper head without any stress peak or undue loading on the weft thread.

The above mentioned change in the clamping force of the scissors clamp can be accomplished by means of a reset spring which is so arranged that the reset spring is connected at one end to the spring biassed scissors clamp plate while the other end is connected to a coupling member which controls the motion of the movable scissors blade, whereby the arrangement is such that a relative motion of the spring connecting points relative to each other takes place during said excess stroke motion.

BRIEF DESCRIPTION OF THE DRAWINGS

In order that the invention may be clearly understood, it will now be described, by way of example, with reference to the accompanying drawings, wherein.

DESCRIPTION OF PREFERRED EMBODIMENTS

Figure 1:
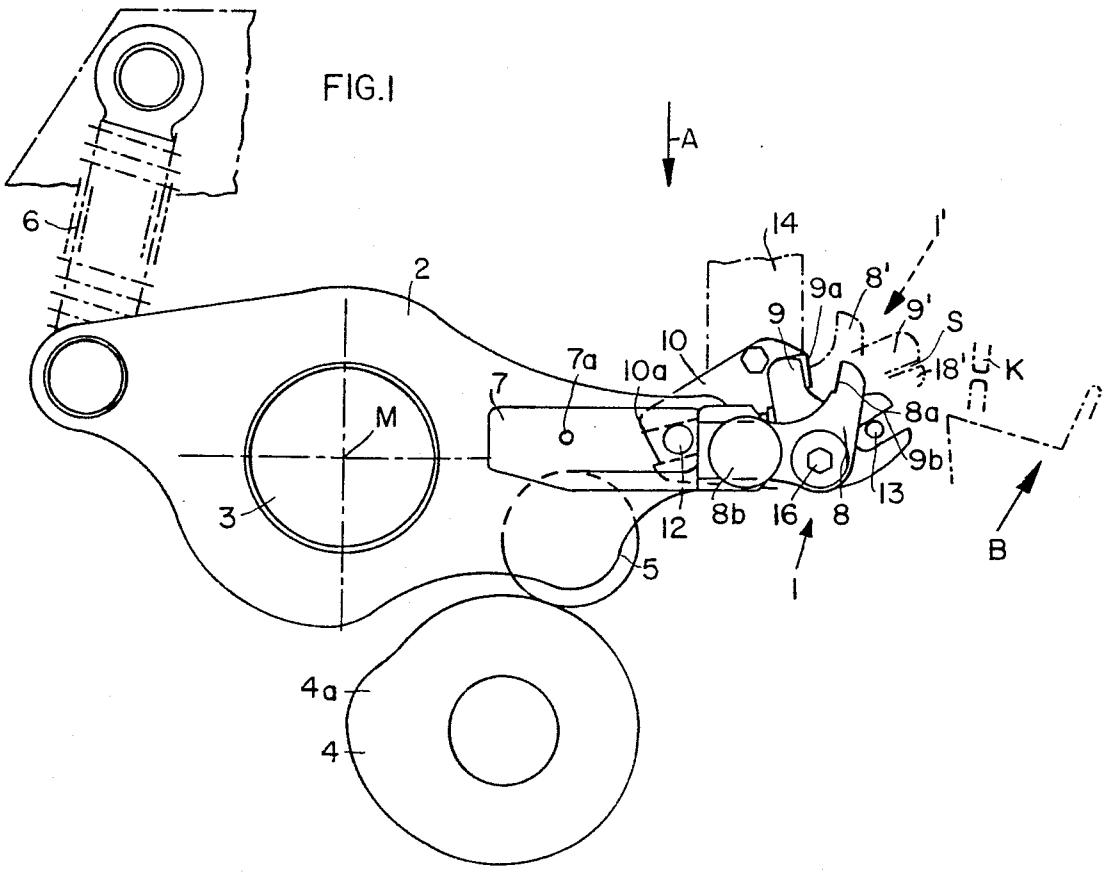
FIG. 1 is a side view of the present weft thread cutting and clamping mechanism, whereby the view direction is out of the loom shed opposite to the inward moving direction of the weft thread gripper rod.
Figure 2:
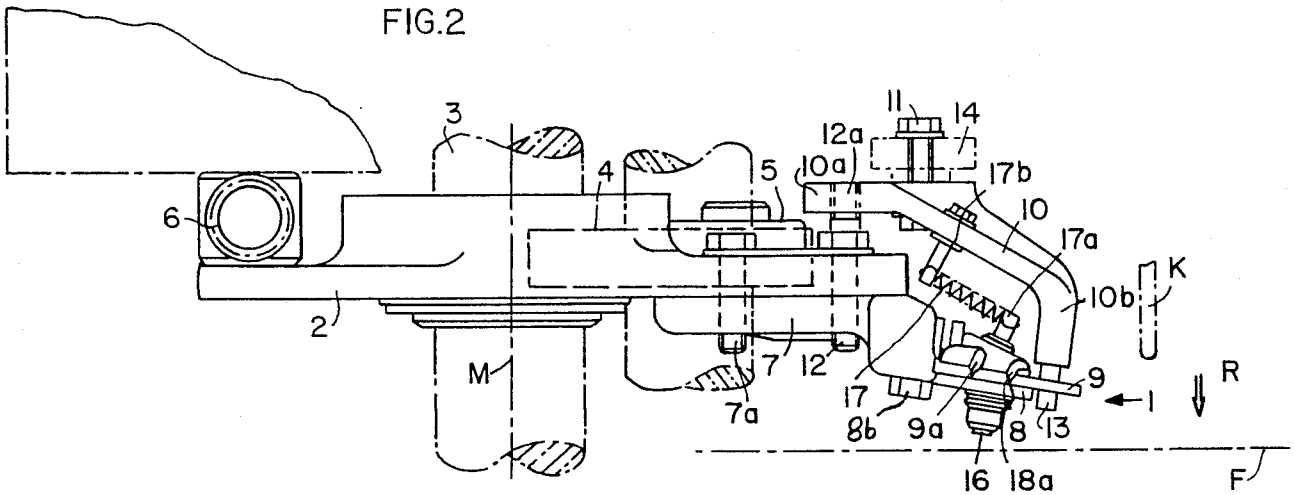
FIG. 2 is a top plan view onto FIG. 1, with a view direction indicated by arrow A in FIG. 1.

The figures are not drawn to scale. Referring first to FIGS. 1 and 2, weft thread scissors 1 are mounted to a scissors mount 7 which in turn is secured to a tiltable arm 2. The tiltable arm 2 is constructed as a double-arm rocking lever and tiltable about a shaft 3 with the aid of an eccentric cam drive 4 cooperating with a cam follower 5 which is biassed against the cam 4 by a spring 6. The spring 6 constantly urges the tiltable lever 2 in the clockwise direction, thereby pressing the cam follower 5 against the cam 4. Rotation of the cam 4 moves the arm 2 in the plane of the drawing sheet of FIG. 1 which extends across the weft thread insertion direction extending perpendicularly to the sheet of the drawing of FIG. 1. The full line position shows the rest position and the dash-dotted position shows the thread presenting position in which the weft thread S is presented to the clamping device K of the gripper head G not shown in FIG. 1, but riding back and forth on the gripper guide B also shown in dash-dotted lines in FIG. 1. The thread inserting direction R is shown in FIG. 2, which also shows the edge F of the fabric being produced by a dash-dotted line.

The weft thread scissors 1 comprises a fixed scissors blade 8 and a movable scissors blade 9. The fixed scissor blade 8 has a cutting edge 8*a* seen in FIGS. 3*a* and 3*b* and is secured to the scissors mount 7, for example, by screws 8*b*. The scissors mount 7 in turn is secured to the tilting arm 2. The connection of the fixed scissors blade 8 to the mount 7 may be such that the position of the blade 8 relative to the mount 7 is adjustable. As shown, the mount 7 is secured to the tilting arm 2 at two locations, namely 7*a* and at 12, whereby the connection 12 comprises an extension cam 12*a* shown in FIG. 2. The extension cam 12*a* engages a forked end 10*a* of a coupling member 10 to be described in more detail below.

The movable scissors blade 9 is journalled to the fixed scissors blade 8 by a journal bearing 16. The movable scissors blade 9 has the shape of a bell crank type lever, the upwardly extending arm of which carries a clamping jaw 9*a* while the other arm is forked as shown at 9*b*. A control cam 13 carried by the coupling member 10 engages into the fork 9*b* for controlling the cutting movement of the scissors 1. The coupling member 10 is journalled to the machine frame 14, shown in dashed lines in FIGS. 1 and 2, by means of a journal bolt 11. The coupling member 10 also forms a double arm lever of which the forked arm 10*a* engages the cam 12 while the other arm 10*b* engages with its cam 13 the fork 9*b*.

The operation will now be briefly described. When the eccentric cam drive 4 lifts the tilting arm 2 and thus the scissors mount 7, the fixed scissors blade 8 is simply displaced upwardly into the dash-dotted working position 8' shown in FIG. 1. The cam 12*a* connected to the arm 2 and also engaging the mount 7 thereby tilts the coupling member 10 about its journal bolt 11 for actuating the movable scissors blade 9 through the control cam 23 which moves the movable blade 9 into the working position 9'. The upward movement of the scissors 1 enables the scissors 1 to seize the weft thread S, whereby the movable blade 9 cuts the thread. However, according to the invention the cutting motion not only provides the just mentioned cut, it also provides a clamping action with the aid of the clamping jaw 9*a* of the movable scissors blade 9 and with the aid of the clamping plate 18*a* of a spring biassed arm 18 also seen in FIGS. 3*a*, 3*b* and 3*c*. The cam projection 4*a* causes an excess stroke bringing the scissors and the clamping arm 18 into the extended position shown with dash-dotted lines at 9' and 18' in FIG. 1. In this excess stroke position the weft thread S is brought as close as possible to the clamping device K of the gripper head G, whereby the waste of weft thread material extending outside the clamping device K of the gripper head is minimized.

Referring to FIG. 2, the stationary scissors blade 8 is located closest to the fabric F. The movable blade 9 is located between the clamping arm 18 and the stationary blade 8. A reset spring 17 is connected to a stud 17*a* of the clamping arm 18 and to a stud 17*b* connected to the coupling member 10.

Figure 3C:
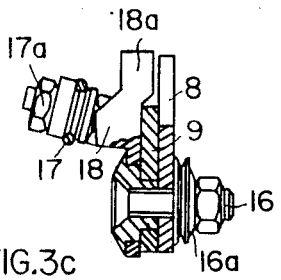
FIG. 3*c* is a sectional view along section line 3*c*—3*c* FIG. 3*a;*
Figure 3A:
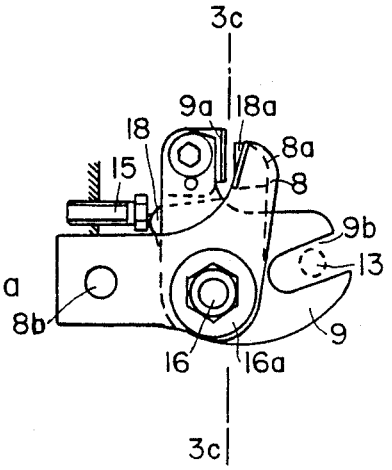
FIG. 3*a* shows further details of the scissors construction in a side view similar to that of FIG. 1.
Figure 3B:
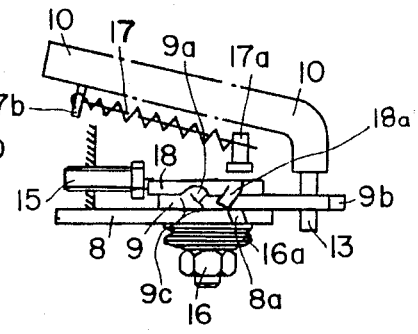
FIG. 3*b* shows further details of the scissors construction in a top plan view similar to that of FIG. 2.

Referring to FIGS. 3*a*, 3*b*, and 3*c*, the fixed scissors blade 8 is connected to the mount 7 at 8*b*. The cutting edge 8*a*, best seen in FIG. 3*b* faces the cutting edge 9*c* and the clamping plate 18*a* faces the clamping jaw 9*a*, also as best seen in FIG. 3*b*. The clamping jaw 9*a* and clamping plate 18*a* are so located relative to each other that the clamping takes place just prior to the cutting by the cutting edges 8*a* and 9*c*. The clamping jaw 9*a* may, for instance, be a separate part screwed to the movable scissors blade 9 constructed as a bell crank. The movable scissors blade 9 is journalled around the journal bearing 16 and pressed against the stationary blade 8 by means of Belleville springs 16*a* to assure a proper cutting engagement between the blades 8 and 9.

As best seen in FIG. 3*c*, the clamping arm 18 is also tiltably mounted on the journal bearing means 16. In FIG. 3*a* the clamping arm 18 is substantially covered up by the blades 8 and 9. The arrangement of the blade 9 and the arm 18 relative to each other is such that the motion of the blade 9 tilts the arm 18 against the force of the spring 17. In other words, the arm 18 is entrained by the motion of the blade 9. The reset spring 17 biases the clamping arm 18 into its rest position against an adjustable stop, for example a screw 15. Thus, the spacing between the clamping jaw 9 and the clamping plate 18 is adjustable. As mentioned above and as shown in FIGS. 3*a* and 3*b*, the spacing between the clamping jaw 9*a* and the clamping plate 18*a* is smaller than the spacing between the two cutting edges 8*a* and 9*c*. More specifically, the clamping plate 18*a* is located somewhat to the left of the cutting edge 8*a* of the fixed blade 8 so that the weft thread S is first clamped and then cut. The clamping location and the cutting location are very close to each other. As soon as the cutting is completed, the movable blade 9 and the arm 18 perform the above mentioned excess stroke into the positions 9' and 18', please see also FIG. 4*c* in which the spacing between the clamping device K of the gripper head and the elements 9 and 18 in their respective positions 9', 18' is shortest as indicated by the short piece S' of weft thread S. FIG. 3*c* also shows, in addition to the above mentioned Belleville springs 16*a* the connection 17*a* of the reset spring 17.

Figure 4A:
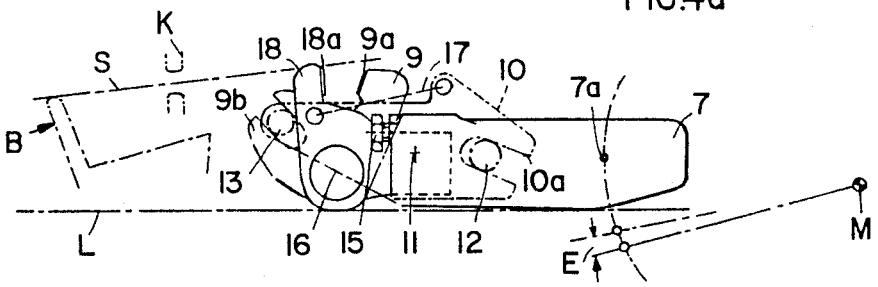
FIG. 4*a* is a view in the direction of the gripper advancement into the loom shed showing the scissors clamp mechanism in a position ready to receive the weft thread.
Figure 4B:
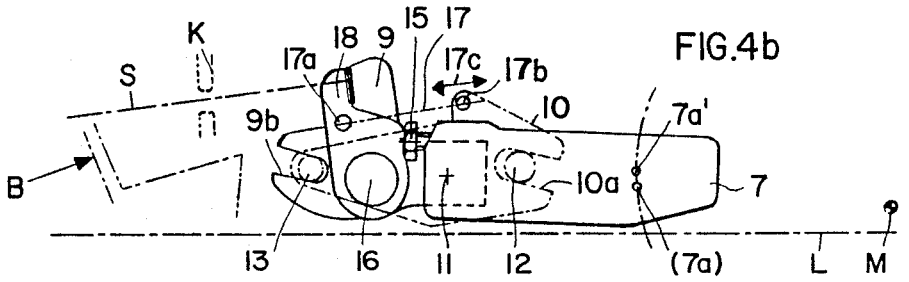
FIG. 4*b* is a view similar to that of FIG. 4*a*, but showing the thread in a clamped condition.
Figure 4C:
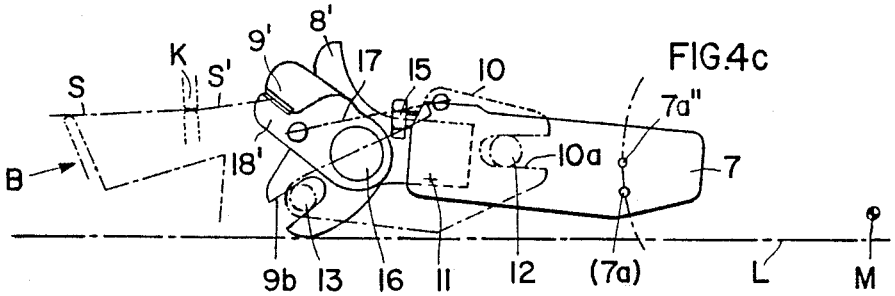
FIG. 4*c* shows the mechanism in the excess stroke condition for presenting the clamped weft thread to the clamp of the gripper head.

Referring to FIGS. 4*a* to 4*c* showing views in the weft thread insertion direction R, the mount 7 is shown in full lines in its position closest to a fixed reference line L in the machine frame. In FIG. 4*a* the clamp formed by the plate 18*a* and the jaw 9*a* is still open. The mount 7 is secured at 7*a*, by arm 2, to a center of rotation M which may be the central longitudinal axis of the shaft 3 also shown in FIGS. 1 and 2. The cam 12 is shown as a dash-dotted circle. The tilting motion of the arm 2 caused by the cam drive 4 is indicated by the spacing E between two radii of the circle around the center M through the connecting point 7*a*. This spacing E corresponds to the stroke of the eccenter cam drive 4. This stroke E determines the movement of the mount 7 relative to the fixed reference line L. FIG. 4*b* shows an intermediate spacing in which the scissors components begin the clamping and cutting action. FIG. 4*c* shows the maximum extension in which the above mentioned excess stroke is performed during which the cut weft thread end is still clamped between the jaw 9*a* and the plate 18*a*.

The fixed blade 8 is not visible in FIG. 4*a* because it is located behind the movable blade 9 and the tiltable arm 18. The arrangement of the components 9, 10, and 18 is such that the force of the reset spring 17 holds a projection of the arm 18 against the adjustable stop 15 and thus the arm 18 in its rest position. By the above mentioned adjustment of the stop 15 it is possible to not only determine the spacing between the clamping jaw 9*a* and the clamping plate 18*a*, but also to determine the point of time when the clamping begins relative to the point of time when the cutting takes place. More specifically, the weft thread S is clamped prior to the cutting to make sure that the cut end of the weft thread cannot jump back in an uncontrolled manner due to the elasticity of the weft thread S. The movable scissors blade 9 and the movable clamping arm 18 are shown in full lines although they appear behind the coupling member 10 which is shown in dash-dotted lines in FIGS. 4*a*, 4*b* and 4*c*. The double arrow 17*c* shown in FIG. 4*b* is to indicate that the connection of the spring 17, for example, at the connecting stud 17*b* may be adjustable for adapting the spring biassing force to any particular requirements. Incidentally, it will be noted from FIGS. 4*a*, 4*b*, and 4*c* that the weft thread S coming from a supply reel is guided by the upper edge of the guide track B of the gripper head G shown in FIG. 5*a*, for example. Due to the above mentioned lifting of the mount 7, the connecting point 7*a* has moved into position 7*a'* in FIG. 4*b* and into position 7*a''* in FIG. 4*c*. Due to the lifting of the mount 7, the cam 12 is also lifted which in turn lifts the coupling member 10 due to the engagement of the cam 12 in the forked end 10*a* of the coupling member 10 which is thus tilted about its journal 11. As a result, the cam 13 moves downward as shown in FIG. 4*c*, thereby lifting the movable blade 9 into its excess stroke position 9' due to the engagement of the cam 13 in the fork 9*b*, thereby tilting the movable blade 9 about its journal axis 16 toward its cutting position and just prior to reaching the cutting position the weft thread S is clamped between the jaw 9*a* and the plate 18*a*. Immediately after the clamping, the cutting is completed. Thereafter, the projection 4*a* of the cam 4 continues to raise the mechanism into the position shown in FIG. 4*c* to perform the mentioned excess stroke at the end of which the elements 9 and 18 assume the positions 9' and 18' for presenting the weft thread S to the clamping device K of the gripper G, whereby the remaining weft thread waste S' is reduced to a minimum.

The arrangement of the reset spring 17 is such that the excess stroke motion shown in FIG. 4*c* causes a displacement of the connections 17*a* and 17*b* relative to the hinging axes of the journal 16 of the arm 18 in such a manner that in spite of the more pronounced stretching of the reset spring 17 the effective lever arm between the clamping plate 18*a* and the journal axis 16 becomes smaller. As a result, the clamping force between elements 9*a* and 18*a* is smaller during the excess stroke. This smaller clamping force still sufficiently holds the weft thread S in a stretched condition, but is small enough to permit the gripper K to withdraw the weft thread from the scissors clamp formed by the elements 9*a* and 18*a*. The withdrawal is sufficiently easy and without any stress peaks so that the weft thread end is treated gently. This is an important advantage of the invention since it avoids damage to the weft thread and hence to the fabric.

Figure 5A:
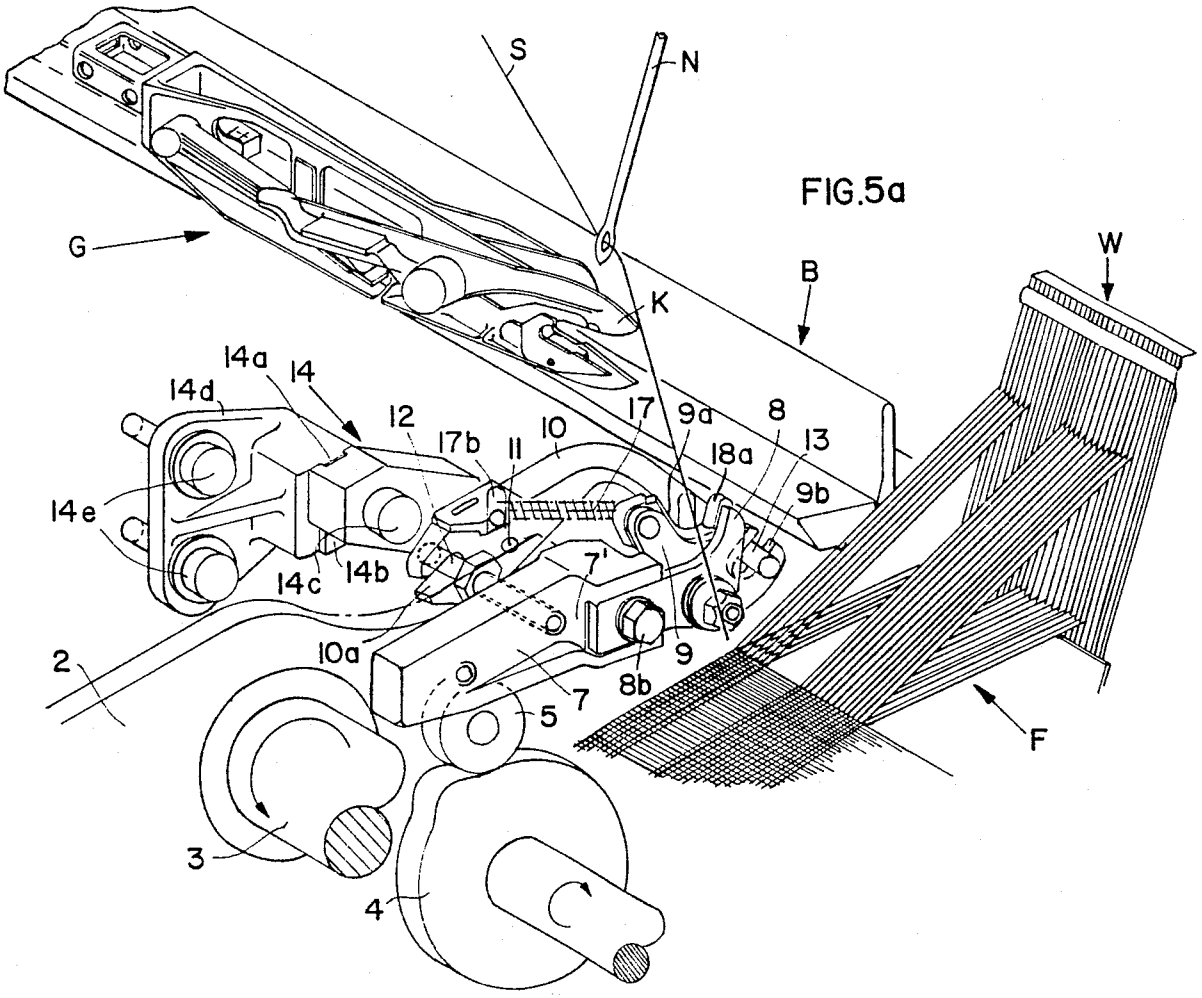
FIG. 5*a* is a perspective view of the present mechanism in the condition approximately corresponding to that of FIG. 4*a*, namely ready to clamp and cut the weft thread.
Figure 5B:
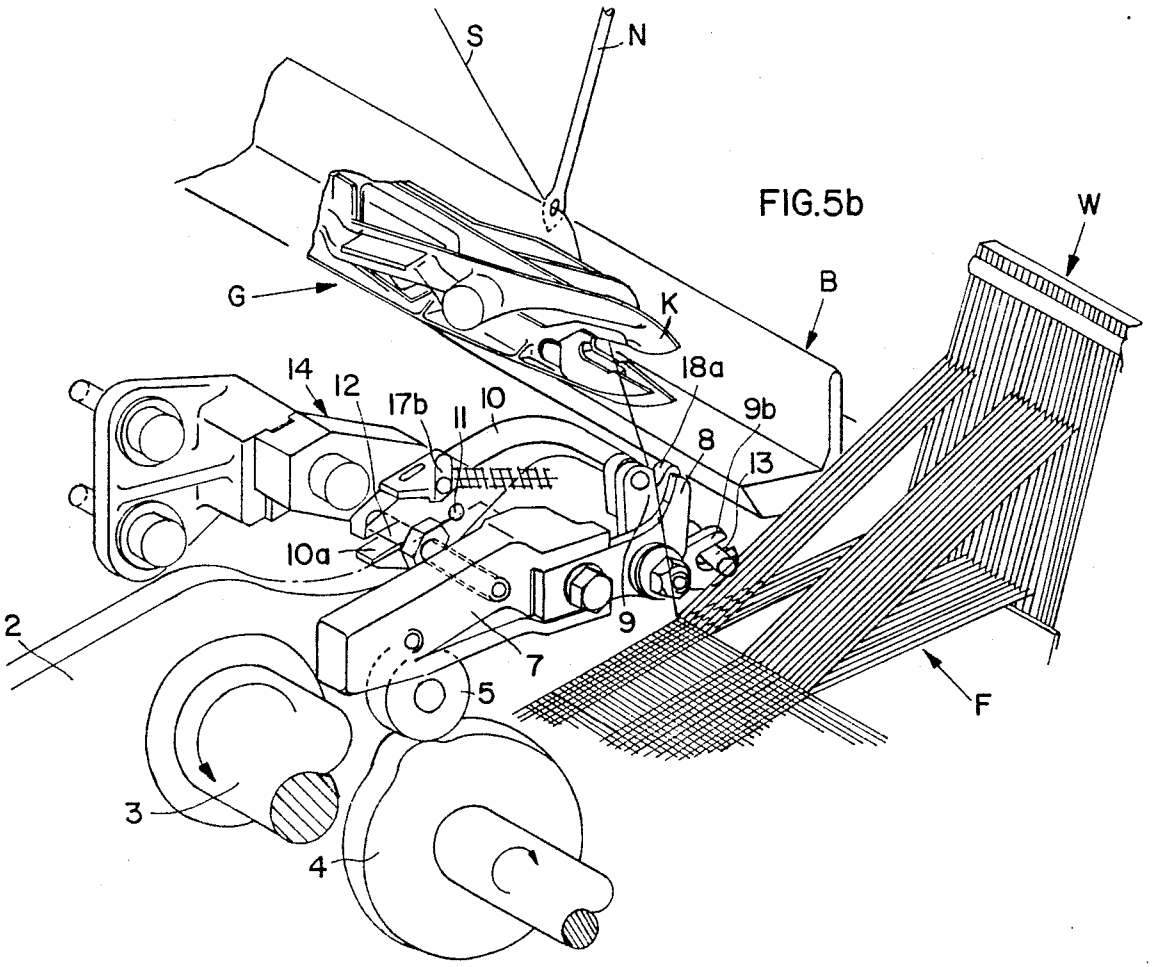
FIG. 5*b* is a perspective view similar to that of FIG. 5*a*, but showing the weft thread in the clamped state.
Figure 5C:
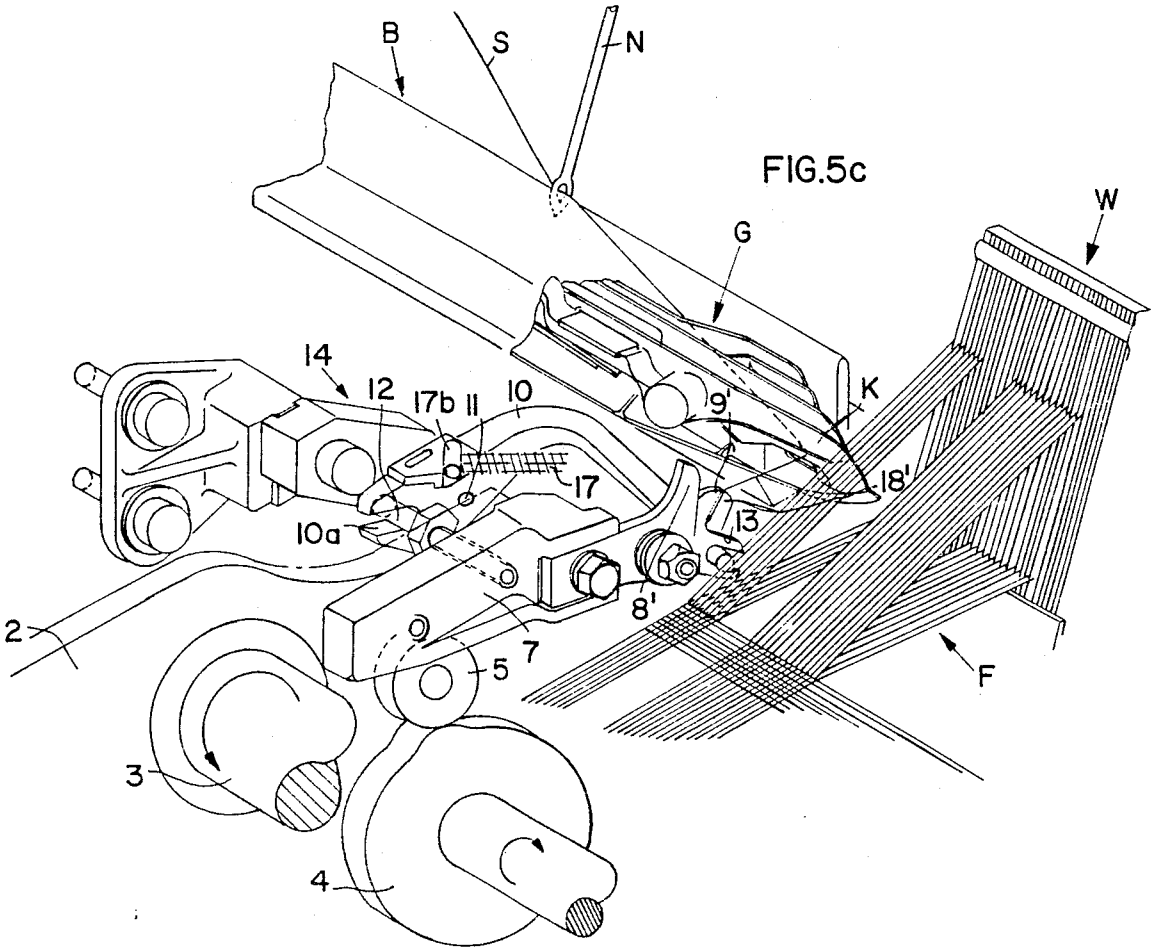
FIG. 5*c* is a view similar to that of FIGS. 5*a* and 5*b*, but showing the mechanism in the excess stroke weft thread presenting position.

FIGS. 5*a*, 5*b*, and 5*c* show a perspective illustration of a somewhat modified embodiment. The same reference numbers are used. These figures show, in addition to the above mentioned elements, the gripper G, a thread presenting needle N, a loom reed W with warp threads, and the more complete loom shed F in its open position. A portion of the finished fabric is also shown. The mounting of the coupling member 10 to the frame 14 is accomplished by an arm 14*a* secured to a dovetail guide 14*b* for an up or down adjustment by a screw 14*c* relative to a bracket 14*d* secured to machine frame components by screws 14*e*. Similarly, a horizontal adjustment may be accomplished by securing the bracket 14*d* to horizontally extending dovetails, not shown, which in turn would be connected to the machine frame. The position of the fixed blade 8 relative to the mount 7 is also adjustable by loosening the screw 8*b* and moving the blade 8 horizontally in a guide 7' of the mount 7. For this purpose, the left-hand end of the blade 8 would have an elongated hole through which the screw 8*b* passes.

FIG. 5*a* shows the weft thread cutting mechanism in its position just prior to the cutting of the weft thread. The gripper G is in its withdrawn position out of the loom shed F. The gripper clamp K is in its open position for seizing the weft thread S presented by the needle N when the gripper G moves back toward the loom shed. At this point the weft thread is still connected to the fabric. The eccentric cam drive 4 is not yet effective so that the scissors are located in their lowest position corresponding to that of FIG. 4*a*. However, the coupling member 10 is in its raised position close to the gripper guide B. The forked end 9*b* of the movable scissors blade 9 is located in its raised position so that the scissors are open.

FIG. 5*b* illustrates the beginning of the drive action of the excentric cam 4, whereby the bend arm of the coupling member 10 is moved downwardly for bringing the movable scissors blade 9 into its closed position with the aid of the cam 13. The weft thread S is in position between clamping jaw 9*a* and the clamping blade 18*a* and the gripper G has advanced slightly toward the shed. The thread S is ready to be clamped.

FIG. 5*c* shows the fully effective position of the cam 4, whereby the tilting arm 2 with the mount 7 is fully lifted, bringing the fixed blade into its position 8'. The operating arm of the coupling member 10 is moved still further downwardly so that elements 9 and 18 are in their excess stroke positions 9' and 18' respectively. The cut end of the thread S is still clamped between 18*a* and 9*a* and the clamp K of the gripper G is closed. Thus, the movement of the gripper G into the shed withdraws the weft thread end from the scissors clamp 9*a*, 18*a*. The cutting of the weft thread takes place close to the edge of the fabric and as close as possible to the clamp K. Any remaining weft thread ends can be conventionally inserted between the edge warp threads.

Figure 6A:
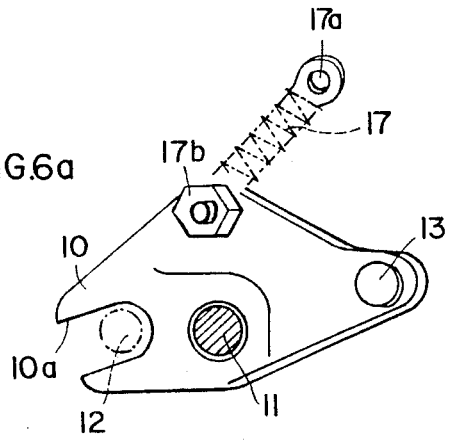
FIG. 6*a* is a side view of a coupling member for controlling the movements of the scissors.
Figure 6B:
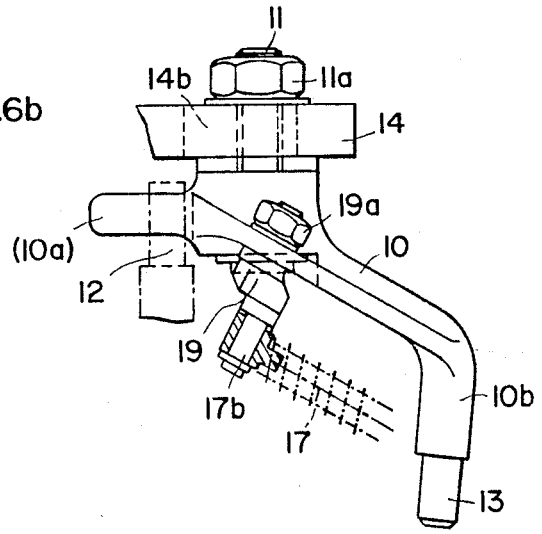
FIG. 6*b* is a top view of the coupling member of FIG. 6*a*.

FIGS. 6*a* and 6*b* show an embodiment of the coupling member 10 constructed as a blade type member functioning, similarly as in FIGS. 4*a*, 4*b*, 4*c* as a double arm lever which is tiltable about its journal bearing 11, for example, in the form of a bolt passing through an elongated hole 14*b* in the frame member 14. Thus, the coupling member 10 can be adjusted within the limits of the elongated hole 14*b* when the nut 11*a* is loosened on the journal bolt 11. The arm 10*b* of the coupling member 10 with its cam 13 is slightly bent downwardly as best seen in FIG. 6*b*. The forked end 10*a* is also slightly bent out of the plane of the main section of the plane of the main section of the coupling member 10. The connection 17*b* of the reset spring 17 to the coupling member 10 comprises an off-set bolt 19 having a threaded end passing through the coupling member 10 and held in place by a nut 19*a*. Due to the upset or cranked portion of the bolt 19 it is possible to adjust the biassing force of the spring 17 by loosening the nut 19*a* and rotating the bolt 19 into a desired position and then tightening the nut 19*a*.

Although the invention has been described with reference to specific example embodiments, it will be appreciated, that it is intended to cover all modifications and equivalents within the scope of the appended claims.

What we claim is:

1. A weft thread cutting mechanism for shuttleless looms in which a weft thread is inserted into a loom shed by weft thread grippers travelling back and forth into and out of the loom shed, comprising scissors means for cutting the weft thread, comprising a fixed scissors blade mounted to a tilting arm drivable by an eccentric cam drive and a further scissors blade which is movable relative to the fixed scissors blade in response to the motion of the tilting arm, whereby said scissors means are tiltable in a plane perpendicularly to the weft thread insertion direction between a rest position and a working position, wherein said fixed scissors blade is located close to said loom shed, wherein said movable scissors blade (9) is located on that side of said fixed scissors blade facing away from the loom shed, said movable scissors blade further comprising a cutting edge and a clamping jaw (9*a*) next to said cutting edge, said scissors means further comprising a clamping plate (18*a*) cooperating with said clamping jaw (9*a*) of said movable scissors blade in an elastically yielding manner, and means for moving said movable scissors blade (9) and said clamping plate (18*a*) into an excess stroke position for moving the weft thread in a direction toward said weft thread grippers, said cutting mechanism further comprising a clamping arm (18) carrying said clamping plate (18*a*), means journalling said clamping arm (18) coaxially with said movable scissors blade (9), and reset spring means arranged for normally biassing said clamping arm (18) into a rest position.

2. The mechanism of claim 1, further comprising means for adjusting the rest position of said clamping arm (18) and thus of said clamping plate (18*a*) relative to said fixed scissors blade.

3. The mechanism of claim 1, further comprising means for adjusting the stroke of the movable scissors blade so that the closing position of the clamping jaw of the movable scissors blade and of the tiltable clamping plate is adjustable so that clamping takes place prior to cutting, and wherein said clamping plate (9*a*) is located ahead of the cutting location of the movable scissors blade (9).

4. The mechanism of claim 1, wherein the movable scissors blade (9) is constructed as a bell crank lever and is mounted on a first journal bearing coaxially with a second journal bearing of said clamping arm (18) carrying said clamping plate (18*a*), said first journal bearing being mounted to the fixed scissors blade (8), and wherein one arm of said bell crank lever of said movable scissors blade (9) has a forked end (9*b*) for cooperation with a cam (13) carried by a coupling member (10) driven by a tilting arm (2, 7) of the scissors means, and means (11) for journalling said coupling member (10) to a machine frame.

5. The mechanism of claim 4, wherein said coupling member (10) is a two-armed lever, one end of said two-armed lever having a forked end for cooperation with a cam driven by said tilting arm and the other end of said two-armed lever having a drive cam (13) for operating said movable scissors blade (9).

6. The mechanism of claim 4, further comprising means (14, 14*a*, 14*b*) for adjusting the position of said journalling means (11) of said coupling member (10) in a plane and direction perpendicularly to the weft thread insertion direction.

7. The mechanism of claim 1, comprising means for controlling the clamping force of the clamping plate (18*a*) as a function of the motion of the clamping plate so that the clamping force is reduced during the excess clamping stroke.

8. The mechanism of claim 7, wherein said means for controlling the clamping force comprise a reset spring for the clamping plate (18*a*), said reset spring being connected at one end to said clamping arm (18) carrying the movable clamping plate (18*d*), the other end of said reset spring being connected to a coupling member (10) in such a manner that when the excess stroke is performed by the movable scissors blade (9), a relative displacement of the spring connecting points (17*a*, 17*b*) takes place which reduces the clamping force of the clamping plate (18*a*) by reducing the length of a lever on which said reset spring is effective.

9. The mechanism of claim 8, wherein at least one spring connecting point (17*b*) is adjustable.

* * * * *